US007710010B2

(12) United States Patent
Iba et al.

(10) Patent No.: US 7,710,010 B2
(45) Date of Patent: May 4, 2010

(54) ELECTRON BEAM APPARATUS

(75) Inventors: Jun Iba, Yokohama (JP); Hisanobu Azuma, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/051,890

(22) Filed: Mar. 20, 2008

(65) Prior Publication Data

US 2008/0238288 A1 Oct. 2, 2008

(30) Foreign Application Priority Data

Apr. 2, 2007 (JP) ..... 2007-096401

(51) Int. Cl.
*H01J 29/86* (2006.01)

(52) U.S. Cl. ..... 313/477 R; 313/495; 313/441

(58) Field of Classification Search ..... None
See application file for complete search history.

(56) References Cited

U.S. PATENT DOCUMENTS

| | | | | |
|---|---|---|---|---|
| 5,023,110 | A | 6/1991 | Nomura et al. | 427/49 |
| 6,703,791 | B2 | 3/2004 | Azuma | 315/169.3 |
| 6,903,504 | B2 * | 6/2005 | Watanabe et al. | 313/495 |
| 6,972,203 | B2 | 12/2005 | Azuma | 438/20 |
| 7,151,005 | B2 | 12/2006 | Azuma | 438/20 |
| 7,211,943 | B2 * | 5/2007 | Watanabe et al. | 313/495 |
| 7,381,578 | B2 | 6/2008 | Azuma | 438/20 |
| 7,382,088 | B2 | 6/2008 | Azuma et al. | 313/495 |
| 2006/0063459 | A1 | 3/2006 | Iba et al. | 445/3 |
| 2006/0087219 | A1 | 4/2006 | Taniguchi et al. | 313/495 |
| 2006/0087220 | A1 | 4/2006 | Hiroki et al. | 313/495 |
| 2006/0145581 | A1 * | 7/2006 | Ito | 313/292 |
| 2006/0164001 | A1 | 7/2006 | Iba et al. | 313/495 |
| 2007/0046173 | A1 * | 3/2007 | Azuma et al. | 313/495 |

FOREIGN PATENT DOCUMENTS

| | | |
|---|---|---|
| JP | 2-56822 | 2/1990 |
| JP | 2006-209991 | 8/2006 |

* cited by examiner

*Primary Examiner*—Ashok Patel
(74) *Attorney, Agent, or Firm*—Fitzpatrick, Cella, Harper & Scinto

(57) ABSTRACT

A three-dimensional structure forming a space in which a wiring-side portion of a device electrode is located is arranged on a rear plate. A surface potential of the three-dimensional structure is defined so that an electric field intensity of the space becomes weaker than an average electric field intensity expressed below, average electric field intensity=$Va/d$, where Va is application voltage of an anode electrode, and d is an interval between a rear plate and the face plate. The device electrode includes a high-temperature portion where temperature locally rises when current flows through the device electrode. The high-temperature portion is positioned in the space or at a distance of less than or equal to 20 μm from the space.

12 Claims, 16 Drawing Sheets

ELECTRON BEAM APPARATUS

BACKGROUND OF THE INVENTION

1. Field of the Invention

The present invention relates to electron beam apparatuses using electron-emitting devices, in particular to an electron beam apparatus having features in an electrode configuration of a rear plate.

2. Description of the Related Art

A usage mode of the electron-emitting device conventionally includes an image display apparatus. A flat electron beam display panel having a configuration in which an electron source plate (rear plate) including great number of cold cathode electron-emitting devices and a face plate including an anode electrode and a light emitting member are faced to each other in parallel and the space in between is exhausted in vacuum is known. The flat electron beam display panel achieves lighter weight and larger screen compared to a cathode-ray tube (CRT) which is currently being widely used. The flat electron beam display panel also provides an image of higher luminance and higher quality compared to a flat display panel using liquid crystals and other flat display panels such as plasma display and electroluminescent display.

In the electron beam display panel, a voltage is applied between the anode electrode and the device to accelerate the electrons emitted from the cold cathode electron-emitting device. High voltage is advantageously applied to obtain maximum light emitting luminance. The electron beam might diffuse before reaching the face plate depending on the type of device. Thus, the distance (inter-substrate distance) between the rear plate and the face plate is preferably short in order to realize a display of high resolution.

However, since high electric field is inevitably generated between the substrates when the inter-substrate distance becomes short, a phenomenon in which the electron-emitting device gets damaged by discharge is likely to occur.

Japanese Patent Application Laid-Open No. 2006-209991 (US2006/164001A1) discloses an electron beam apparatus that prevents melting and disconnection of device electrodes and that prevents creeping discharge by flowing discharge current to an additional electrode arranged at the end of the device electrode.

SUMMARY OF THE INVENTION

However, a method of quenching discharge itself before the discharge current reaches a maximum value is desired to further suppress the influence by the discharge.

In view of the above problem, it is an object of the present invention to provide an electron beam apparatus capable of suppressing discharge at a lower current value and in a short period of time.

According to a first aspect of the present invention, there is provided an electron beam apparatus including a rear plate including an electron-emitting device with a device electrode and a wiring connected to the device electrode; and a face plate which includes an anode electrode, which is arranged facing the rear plate, and which is irradiated with electrons emitted from the electron-emitting device; wherein a three-dimensional structure forming a space in which a wiring-side portion of the device electrode is located is arranged on the rear plate; wherein a surface potential of the three-dimensional structure is defined so that an electric field intensity of the space becomes weaker than an average electric field intensity expressed below, $$\text{average electric field intensity} = Va/d,$$

where Va is application voltage of the anode electrode, and d is an interval between the rear plate and the face plate; wherein the device electrode includes a high-temperature portion where temperature locally rises when current flows through the device electrode, the high-temperature portion being positioned in the space or at a distance of less than or equal to 20 μm from the space.

In the present invention, the wiring-side portion of the device electrode is arranged in the space of weaker electric field intensity than the average electric field intensity, and thus the cathode spot generated on the device electrode by discharge gradually weakens in the space while moving in the wiring direction, and is quenched in a short period of time. Thus, in the electron beam apparatus of the present invention, the discharge can be suppressed more efficiently and with less damage than the prior art.

Further features of the present invention will become apparent from the following description of exemplary embodiments with reference to the attached drawings.

DESCRIPTION OF THE EMBODIMENTS

A preferred embodiment of the present invention will be described below. An electron beam apparatus of the present invention, in summary, includes a rear plate having an electron-emitting device with a device electrode and a wiring connected to the device electrode; and a face plate which includes an anode electrode, which is arranged facing the rear plate, and which is irradiated with the electron emitted from the electron-emitting device. A three-dimensional structure forming a space in which a wiring-side portion of the device electrode is located is arranged on the rear plate. The electron beam apparatus according to the first embodiment adopts a three-dimensional structure having a shape including a cantilever-like protruding portion which protrudes over the wiring-side portion of the device electrode. In the following description, the three-dimensional structure in the first embodiment is referred to as "first three-dimensional structure" and a space between the protruding portion of the first three-dimensional structure and the rear plate is referred to as "first space", for the sake of convenience. The wiring-side portion of the device electrode is arranged in the first space in the first embodiment. An electron beam apparatus according to a second embodiment adopts a three-dimensional structure including two wall portions arranged on both sides of the wiring-side portion of the device electrode. The three-dimensional structure in the second embodiment is referred to as "second three-dimensional structure", and a space between the two wall portions of the second three-dimensional structure is referred to as "second space". The wiring-side portion of the device electrode is arranged in the second space in the second embodiment.

An electron-emitting device of any of the types of field emission electron-emitting device, MIM device (metal-insulator-metal electron-emitting device), or surface conduction electron-emitting device may be used for the electron beam apparatus of the present invention. In particular, the present invention is preferably applied to an electron beam apparatus generally referred to as a high voltage type in which a voltage of greater than or equal to a few kV is applied in that discharge is likely to occur.

The preferred embodiment of the present invention will be specifically described below using the surface conduction electron-emitting device by way of example. The representative configuration, manufacturing method, and characteristics of the surface conduction electron-emitting device are disclosed in Japanese Patent Application Laid-Open No. 2-56822 and the like.

Figure 6:
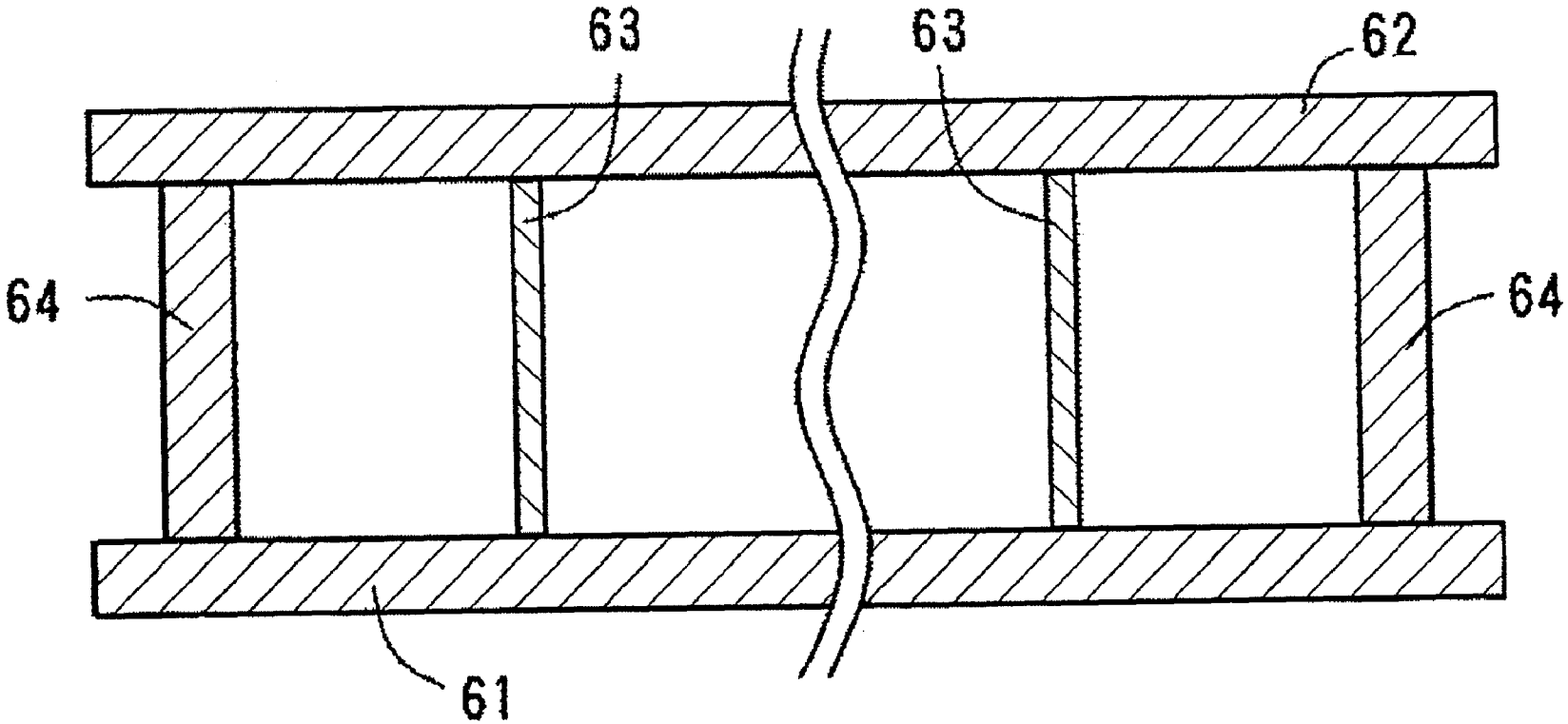
FIG. 6 is a schematic view showing a basic configuration of the electron beam apparatus.

A basic configuration of the electron beam apparatus of the present invention is shown in FIG. 6. The electron beam apparatus includes a rear plate 61, a face plate 62 arranged facing the rear plate 61, and a frame member 64 fixed at the peripheral edge of the plates 61, 62 and configuring an outer vessel with the plates 61, 62. Normally, a spacer 63 (constituting member such as plate shape, column shape, rib, etc.) that holds the distance between the plates 61, 62 and at the same time, functions as an atmospheric pressure resistance structure is arranged between the rear plate 61 and the face plate 62. An electron source, and electrodes and wirings for driving the electron source are arranged on the rear plate 61.

Figure 1:
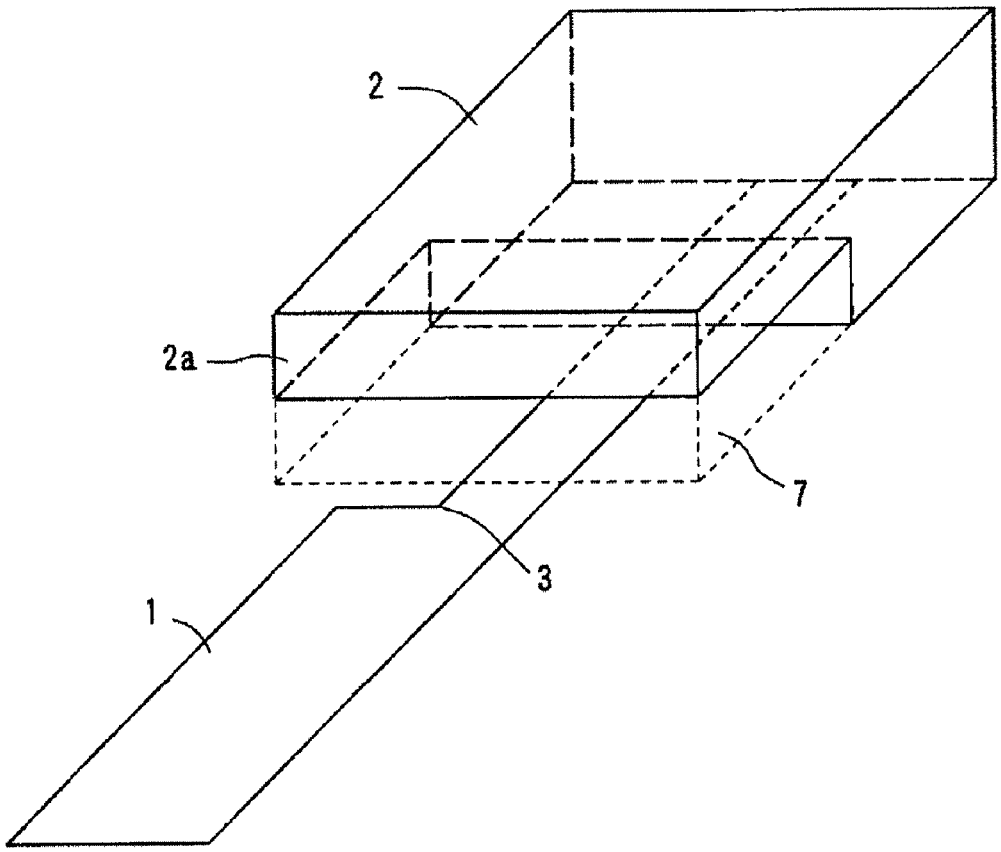
FIG. 1 is a perspective view showing in frame format a first embodiment of an electron beam apparatus of the present invention.

FIG. 1 is a perspective view showing in frame format a configuration of the electron beam apparatus of the first embodiment of the present invention. In FIG. 1, reference numeral 1 denotes the device electrode, 2 denotes the first three-dimensional structure, 2*a* denotes the cantilever-like protruding portion or one portion of the first three-dimensional structure, 3 denotes a high-temperature portion, and 7 denotes the first space.

Figure 2A:
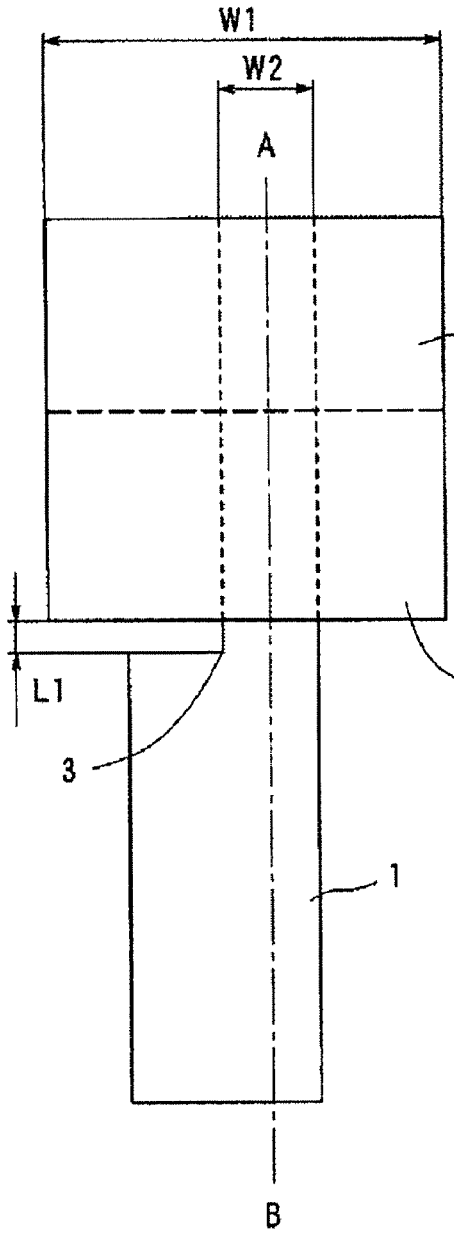
FIG. 2A shows a plan frame format view of the embodiment shown in FIG. 1.
Figure 2B:
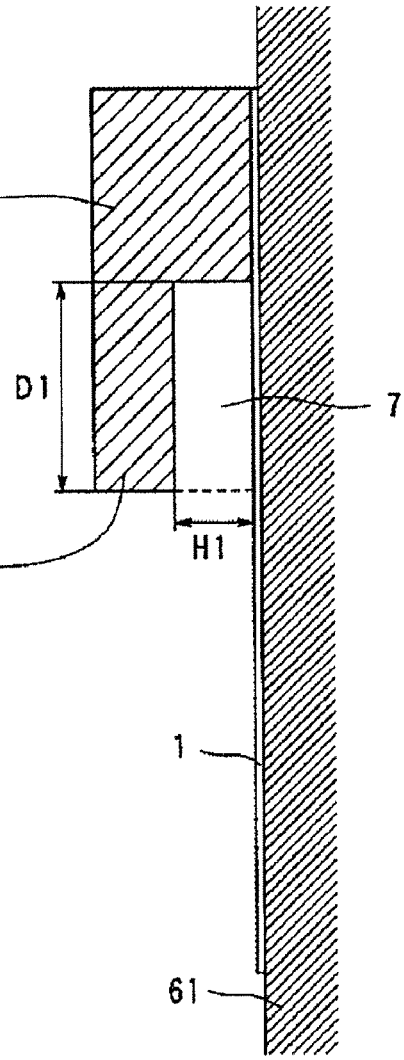
FIG. 2B is a cross sectional frame format view.

FIG. 2A shows a plan frame format view of the electron beam apparatus of FIG. 1, and FIG. 2B is a cross sectional frame format view taken along line A-B of FIG. 2A.

The first three-dimensional structure 2 is formed on the device electrode 1, and has a configuration in which the cantilever-like protruding portion or one portion of the first three-dimensional structure 2 covers the wiring connection side of the device electrode 1. The "cantilever-like protruding portion" of the three-dimensional structure 2 in the present invention is a site where one end is fixed and supported and the other end is a free end in a so-called cantilever state, which site itself is a site that does not easily deform such as bend, warp, or twist. The high-temperature portion 3 of the device electrode 1 is a position where the temperature locally rises when current of conduction process etc., to be hereinafter described, flows through the device electrode 1. This position is equivalent to a position where the temperature locally rises when discharge current flows through the device electrode 1. In the example of FIGS. 1 and 2A, the high-temperature portion 3 is formed by discontinuously changing the width of the device electrode 1.

The first space 7 is a space sandwiched by the protruding portion 2*a* of the first three-dimensional structure 2 and the rear plate 61. One portion (wiring-side portion) of the device electrode 1 is arranged in the first space 7. As hereinafter described, the surface potential of the first three-dimensional structure 2 is set so that the electric field intensity of the first space 7 becomes weaker than average electric field intensity in the panel (outer vessel). In the first embodiment, discharge is suppressed by the first space 7.

Generally, device discharge, foreign substance discharge, and protrusion discharge are mainly considered for the discharge within the panel. With the device discharge, the electron-emitting device gets damaged by overvoltage, which acts as a trigger in causing discharge. With the foreign substance discharge, the foreign substances mix into the panel, and discharge occurs while the foreign substances move. With the protrusion discharge, electron-emission occurs in excess from the unnecessary protrusions in the panel thereby causing discharge. In the foreign substance discharge, the protrusion discharge, and the device discharge, the discharge moves to the device electrode after discharge generation, and thus the discharge advances through substantially similar process. The present invention achieves suppression effect on any one of the discharges.

FIGS. 3A to 3D show the discharge advancing process of when discharge occurs at the device electrode having the configuration of FIG. 1. Here, the first three-dimensional structure 2 is electrically connected to the wiring.

Figure 3A:
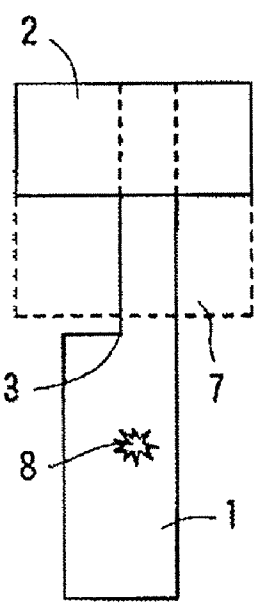
FIGS. 3A to 3D are views showing a typical advancing process of discharge on a device electrode in the configuration of FIG. 1.
Figure 3B:
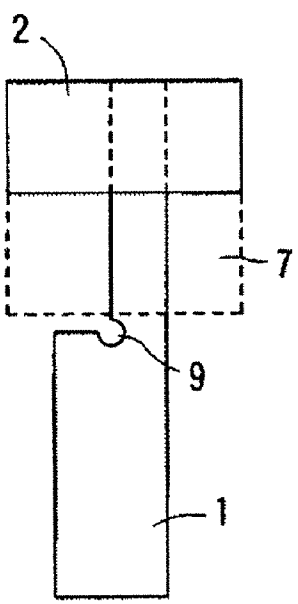
Figure 3C:
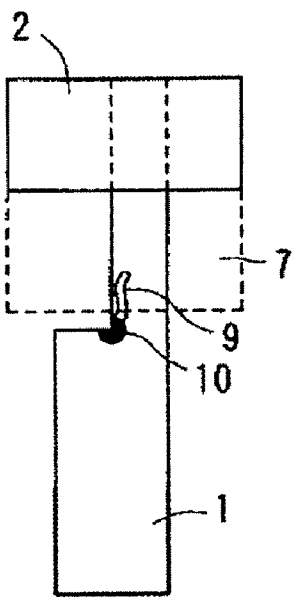
Figure 3D:
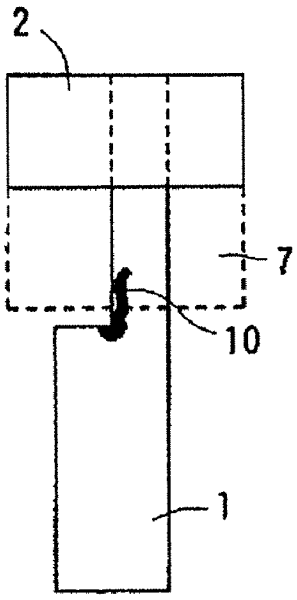

First, discharge 8 is generated at the device electrode 1 [FIG. 3A]. This becomes a trigger and the discharge current flows in from the anode electrode (not shown) arranged on the face plate 62, and the discharge advances. In this case, the temperature of the high-temperature portion 3 of the device electrode 1 rises by concentration of current, and a cathode spot 9 forms when the member configuring the device electrode 1 melts and evaporates [FIG. 3B]. The cathode spot 9 starts to move with the high-temperature portion 3 as the starting point [FIG. 3C]. A damage 10 at where the constituting member of the device electrode 1 is disappeared remains at the path the cathode spot 9 has moved. Since the cathode spot 9 moves towards lower potential, the cathode spot 9 moves towards the side closer to the ground potential, that is, the wiring side. The wiring-side portion of the device electrode 1 is in the first space 7, and thus the cathode spot 9 moves into the first space 7. Since the electric field intensity is weakened in the first space 7, the energy of the cathode spot 9 that has entered into the first space 7 also gradually weakens, and the cathode spot 9 in the first space 7 ultimately stops advancing and quenches [FIG. 3D].

Figure 4:
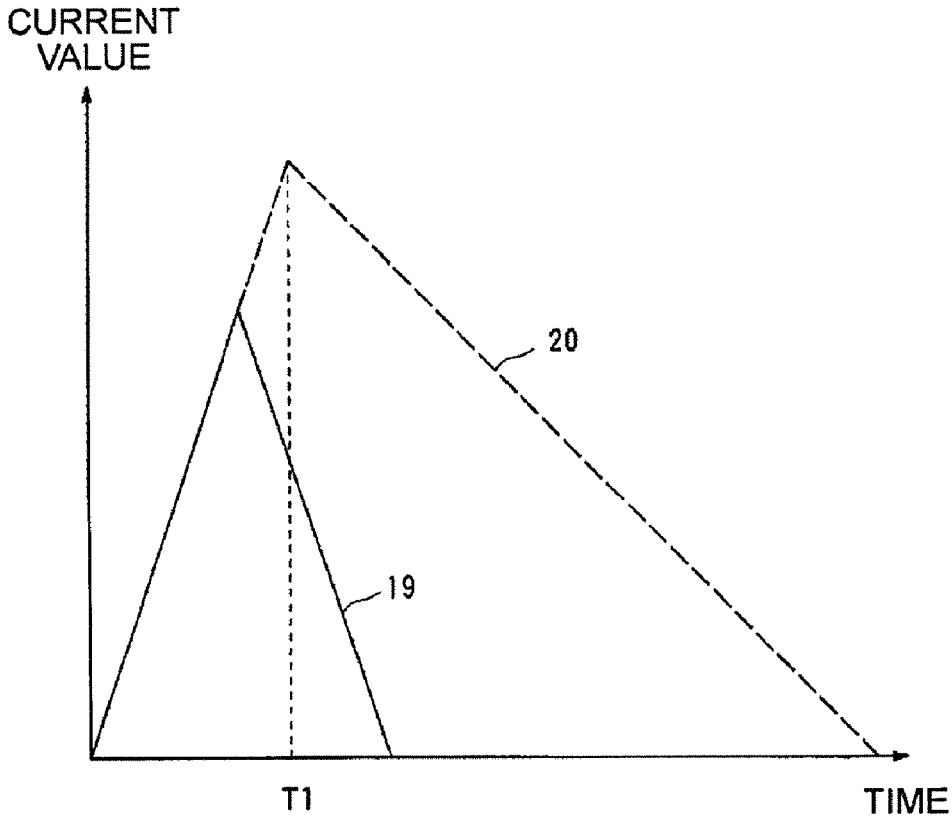
FIG. 4 is a view showing a discharge current waveform in the electron beam apparatus.

FIG. 4 shows a graph of discharge current of when going through the discharge advancing process of FIGS. 3A to 3D. In FIG. 4, a solid line 19 shows change in discharge current in the first embodiment. A broken line 20 shows discharge current of when the first space 7 is not provided (when cathode spot 9 is not quenched). The discharge current 20 of when the first space 7 is not provided is determined by the characteristics of the face plate 62. According to the first embodiment, the cathode spot 9 is quenched and the discharge current is suppressed by the first space 7.

Either the high-temperature portion 3 of the device electrode 1 is positioned in the first space 7, or the distance (L1 in FIG. 2A) from the high-temperature portion 3 to the first space 7 is less than or equal to 20 μm.

Normally, the rise time (time T1 of FIG. 4) of the discharge current is about 50 to 100 ns. The moving speed of the cathode spot 9 is about 50 to 200 m/sec.

$$50\times50\times10^{-9}=2.5\times10^{-6}$$

$$100\times200\times10^{-9}=20\times10^{-6}$$

The distance L1 between the first space 7 and the high-temperature portion 3 is less than or equal to 20 μm, and preferably less than or equal to 2.5 μm in order to move the cathode spot 9 to the first space 7 and suppress discharge by the discharge rise time T1. If a Pt electrode having a thickness of 10 to 50 nm is used, the rise time of the discharge current is 100 ns and the moving speed of the cathode spot is about 100 m/sec, and thus the distance L1 is preferably 20 μm≧L1. A configuration in which the high-temperature portion 3 is positioned inside the first space 7 is more preferable.

Figure 5:
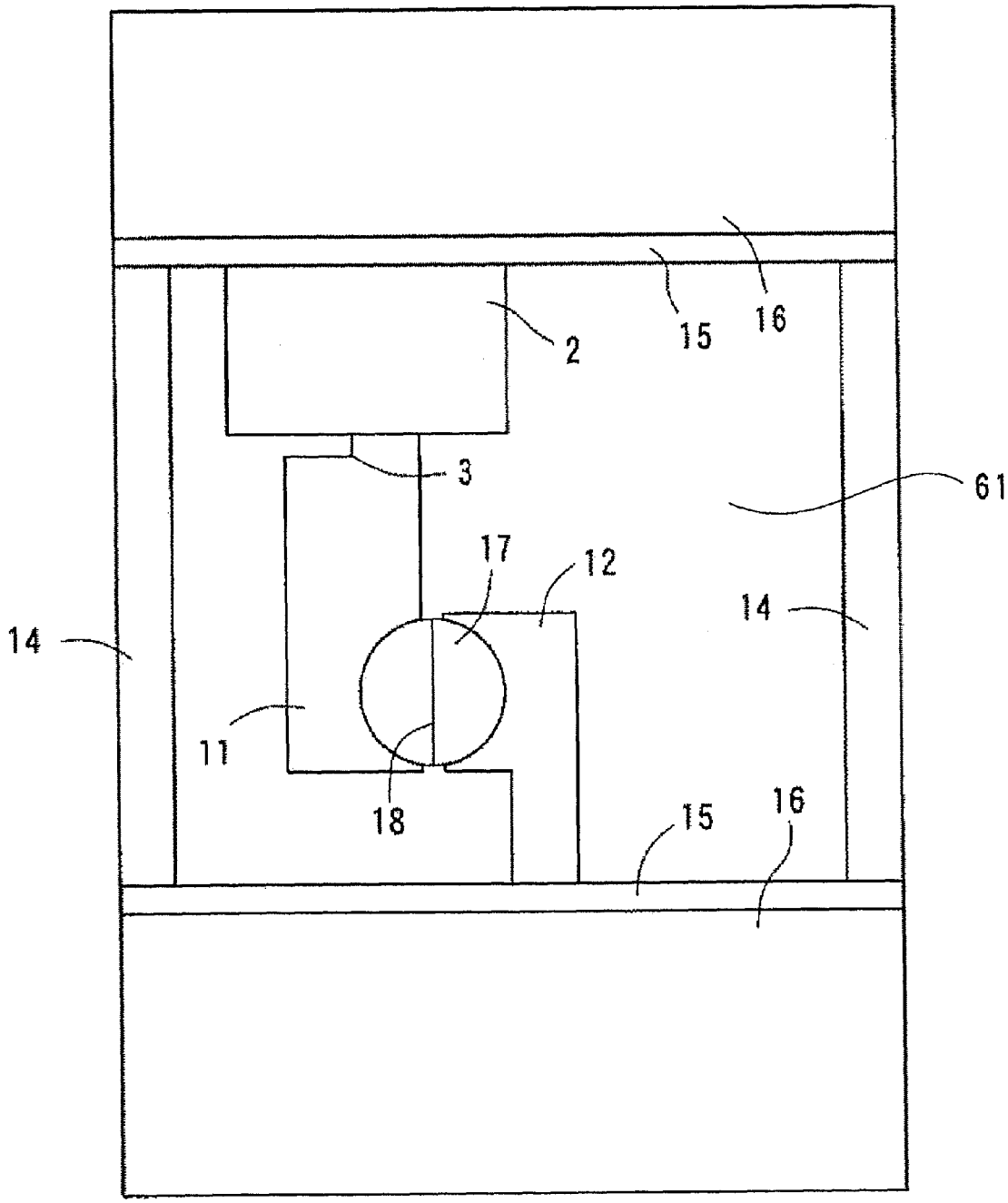
FIG. 5 is a plan view showing in frame format a relationship of the device electrode and a wiring of FIG. 1.

FIG. 5 shows in frame format a relationship between the device electrode and the wiring of FIG. 1. In FIG. 5, reference numeral 11 denotes a scan signal device electrode, and is the device electrode 1 of FIG. 1. Reference numeral 12 denotes an information signal device electrode, 2 denotes the first three-dimensional structure, 3 denotes the high-temperature portion, 14 denotes an information signal wiring (first wiring), 15 denotes an insulating layer, 16 denotes a scan signal wiring (second wiring), 17 denotes a device film, and 18 is an electron-emitting portion formed in the device film 17. The information signal wiring 14 intersects with the scan signal wiring 16 across the insulating layer 15. The scan signal device electrode 11 and the information signal device electrode 12 configure a pair of device electrodes. The pair of device electrodes 11, 12 and the device film 17 configure the electron-emitting device. The scan signal device electrode 11 and the scan signal wiring 16 may be directly connected, or the scan signal device electrode 11 and the scan signal wiring 16 may be connected by way of the first three-dimensional structure 2 if the first three-dimensional structure 2 is made of conductive material such as metal. An example where the first three-dimensional structure 2 is connected to the scan signal device electrode 11 is shown in this example, but the present invention is not limited thereto. For instance, if the discharge current also flows to the information signal device electrode 12, a configuration of arranging the first three-dimensional structure 2 on the information signal device electrode 12 side or a configuration of arranging the first three-dimensional structure 2 on both sides of the scan signal device electrode 11 and the information signal device electrode 12 may be adopted. Furthermore, similar effect is obtained even if the stacking relationship of the information signal wiring 14 and the scan signal wiring 16 is turned upside down.

If the first three-dimensional structure 2 is manufactured with the same process as the information signal wiring 14 and the scan signal wiring 16 or the insulating layer 15 as one part thereof, a new mask becomes unnecessary, and lower cost is achieved.

Figure 7:
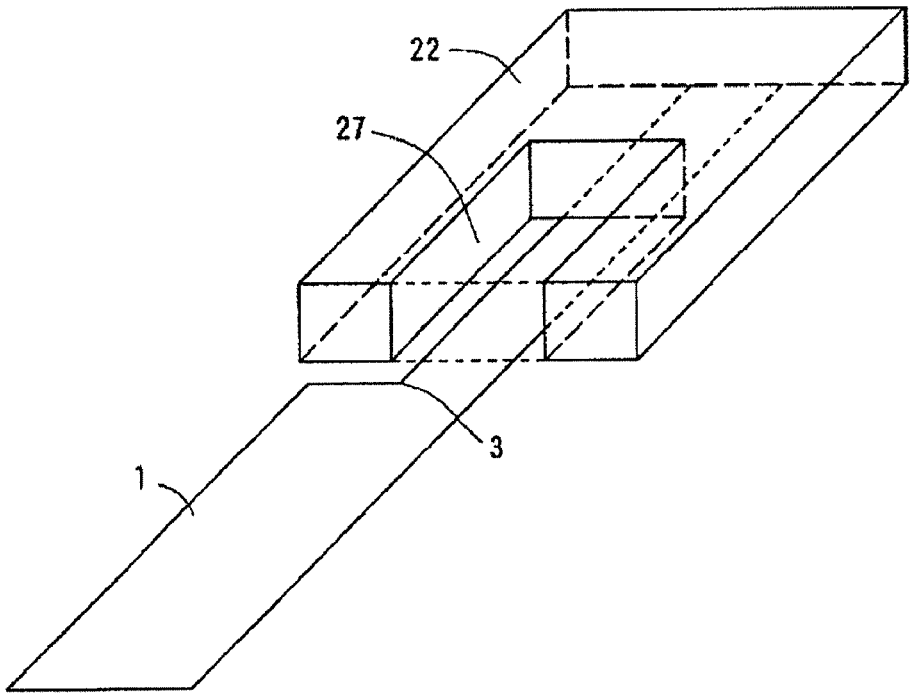
FIG. 7 is a perspective view showing in frame format a second embodiment of the electron beam apparatus of the present invention.

FIG. 7 is a perspective view showing in frame format a configuration of an electron beam apparatus according to a second embodiment of the present invention. In the figure, the reference numeral 1 denotes the device electrode, 22 denotes the second three-dimensional structure, and 3 denotes the high-temperature portion.

Figure 8A:
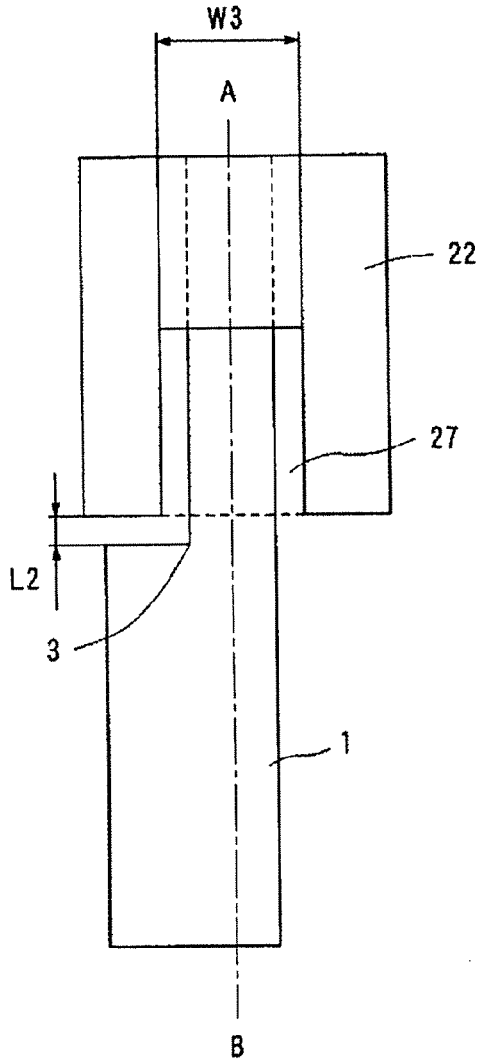
FIG. 8A shows a plan frame format view of the embodiment shown in FIG. 7.
Figure 8B:
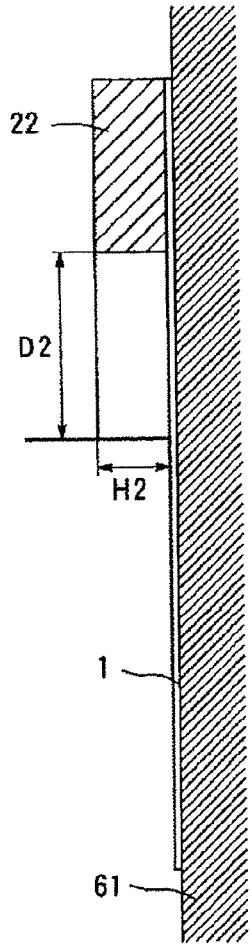
FIG. 8B is a cross sectional frame format view.

FIG. 8A is a plan frame format view of the electron beam apparatus of FIG. 7, and FIG. 8B is a cross sectional frame format view taken along line A-B of FIG. 8A.

The second three-dimensional structure 22 includes two wall portions arranged so as to sandwich the device electrode 1 in the width direction. One part (wiring-side portion) of the device electrode 1 is arranged in the second space 27 between the two wall portions. In the example of FIG. 7, the second three-dimensional structure 22 has a U-shape in plan view, but the second three-dimensional structure 22 is not limited thereto as long as it has wall portions on both sides in the width direction of the device electrode 1 in the present invention.

The electron beam apparatus of the first embodiment and the electron beam apparatus of the second embodiment have the same configuration and the same effect other than that the structure of the three-dimensional structure for forming a space for suppressing the discharge current is different. In other words, in the electron beam apparatus of the second embodiment as well, the high-temperature portion 3 is formed in the device electrode 1, and either the high-temperature portion 3 is positioned within the second space 27 or the distance L2 (see FIG. 8A) from the high-temperature portion 3 to the second space 27 is less than or equal to 20 μm, and preferably less than or equal to 2.5 μm.

The material of the three-dimensional structure 2, 22 includes metal materials such as aluminum, titanium, chromium, nickel, copper, molybdenum, ruthenium, silver, tungsten, platinum, and gold; insulating material such as frit glass of Bi or Ba, Pb, and the like. The formation method includes a thick film printing method of printing and firing a thick film paste in which metal component and glass component are mixed in a solvent, an offset printing method using metal paste, and the like. If the insulating material is used for the three-dimensional structure 2, 22, the potential thereof is preferably regulated by covering an antistatic film and metal thin film. The specified potential is preferably a ground potential, and higher discharge suppressing effect is obtained if in particular, lower than or equal to the wiring potential (preferably negative potential). The material having a thickness of a few μm is preferable in terms f forming the space 7, 27. Furthermore, a configuration in which the width W1, W3 of the three-dimensional structure (see FIGS. 2A and 8A) is made wider than the width W2 of the device electrode 1 so that the space 7, 27 completely envelops the device electrode 1 at the boundary of the space 7, 27 on the side the cathode spot 9 enters is preferable to more reliably move the cathode spot 9 to the space 7, 27.

The material of the device electrode 1 includes aluminum, titanium, chromium, nickel, copper, molybdenum, ruthenium, silver, tungsten, platinum, and gold. A thin-film of about 0.01 to 0.3 μm is preferable in terms of electron-emitting device characteristics and small step difference with the device film 7.

The high-temperature portion 3 is a portion where the temperature locally rises in the device electrode 1. A configuration of concentrating current not by changing the width of the device electrode 1 but by changing the thickness, forming a region which curvature radius of the corner is small, and the like may be adopted. A configuration of forming a region of high power consumption by locally using high resistance material etc. may also be adopted. A plurality of high-temperature portions 3 may be formed, but is preferably one to facilitate the control of the cathode spot 9.

The electric field intensity (electric field intensity distribution of the inside of the space) of the first space 7 and the second space 27 is set weaker than average electric field intensity of the panel. The electric field intensity of the space 7, 27 is easily obtained by performing an electrostatic field calculation using parameters such as shape and physicality value of each member of the rear plate 61, voltage applied to the anode electrode of the face plate 62, and interval between the rear plate 61 and the face plate 62. The magnitude of the electric field intensity can also be expressed with a solid angle of the face plate 62.

Figure 9:
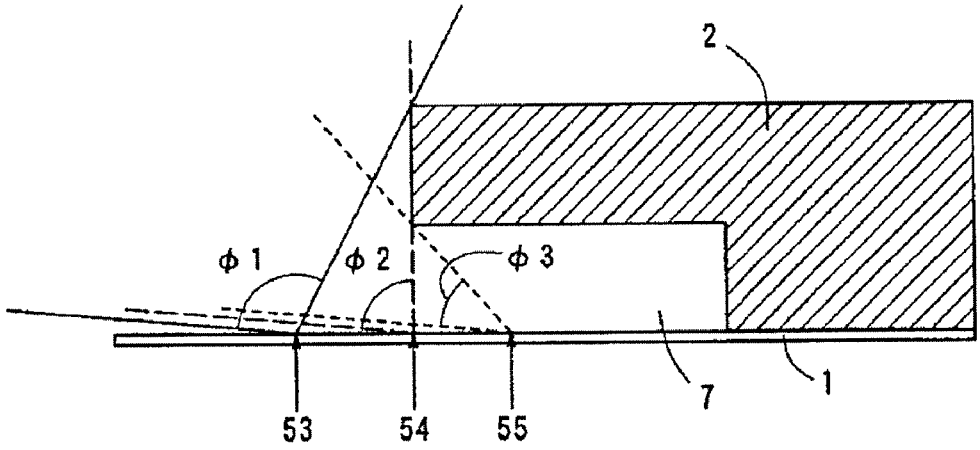
FIG. 9 is a view showing a method of representing the electric field intensity of the first space with solid angle of the face plate.

The solid angle of each position 53, 54, 55 in the first three-dimensional structure 2 of FIG. 1 will be described using FIG. 9. With respect to a solid angle of the face plate 62 at each position, an apex angle is assumed to be $\phi n$ (n=1, 2, 3) over the entire periphery. In this case, the solid angle $\Omega n$ at each position is:

$$\Omega n = 2\pi(1-\cos \phi n).$$

As seen from the figure, $\phi 1 > \phi 2 > \phi 3$. The solid angle $\Omega n$ becomes smaller the farther in the first three-dimensional structure 2 from the above equation, and as a result, the electric field intensity becomes weak.

The average electric field intensity of the panel is expressed as Va/d (application voltage Va of the anode electrode of the face plate 62, the interval d between the rear plate 61 and the face plate 62). It is experimentally found that it is effective if the electric field intensity of the first space 7 and the second space 27 is weaker than the above-described average electric field intensity, and preferably less than or equal to 1% of the average electric field intensity.

The shape of the first space 7 and the second space 27 preferably has a configuration of creating a wider region while weakening the electric field intensity. That is, with respect to the first space 7, W1 and D1 are made large and H1 is made small in FIGS. 2A and 2B. With respect to the second space 27, H2 and D2 are made large and W3 is made small in FIGS. 8A and 8B. For instance, the conditions of first space 7: $D1/H1>1$ second space 27: $H2/W3>1.5$ are given to have the electric field intensity ratio with respect to the average electric field intensity to lower than or equal to 1/100 (if three-dimensional structure 2, 22 are potential regulated).

The region (related to D1, D2) for quenching the cathode spot 9 needs to be a few μm to a few dozen μm in terms of moving speed of the cathode spot 9.

The effect of the present invention is obtained in the three-dimensional structure 2, 22 of any shape by arranging the high-temperature portion 3 at a predetermined position, and taking the above requirements into consideration.

Figure 10A:
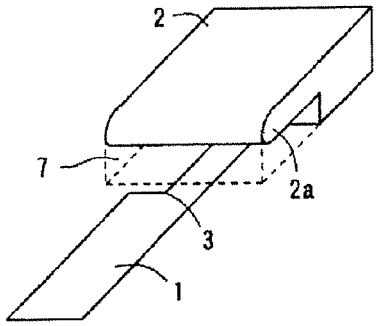
FIGS. 10A and 10B are perspective views showing another mode of the first three-dimensional structure.
Figure 10B:
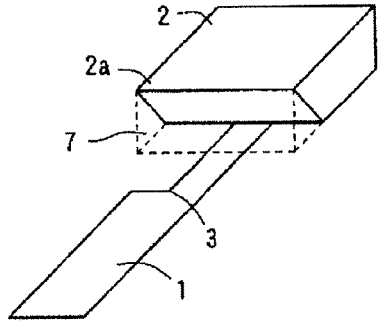
Figure 10C:
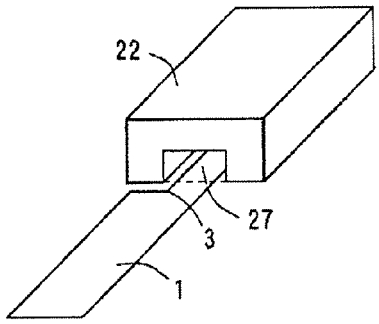
FIGS. 10C and 10D are perspective views showing another mode of the second three-dimensional structure.
Figure 10D:
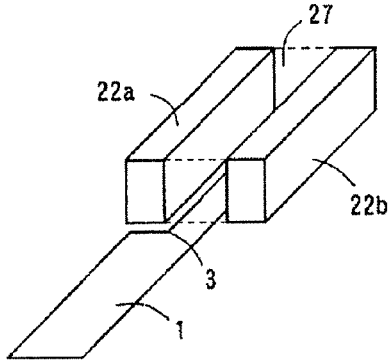

FIGS. 10A to 10D show another mode of the first and second three-dimensional structures 2, 22. FIGS. 10A and 10B show an example of the first three-dimensional structure 2, and FIGS. 10C and 10D show an example of the second three-dimensional structure 22.

FIG. 10A is an example in which the distal end of a protruding portion 2*a* of the first three-dimensional structure 2 has curvature. FIG. 10B is an example in which the protruding portion 2*a* of the first three-dimensional structure 2 has a reverse tapered shape. FIG. 10C is an example in which the second three-dimensional structure 22 includes a cavity and the device electrode 1 is positioned in the cavity. That is, a lid portion covering the upper part of the second space 27 is formed on the two wall portions of the second three-dimensional structure 22. FIG. 10D is an example in which the second three-dimensional structure 22 is formed with two members (wall portions) 22*a*, 22*b* arranged at positions sandwiching the device electrode 1 in the rear plate face.

In the present invention, effects based on the above concept are obtained even if the first and second three-dimensional structures 2, 22 or first and second spaces 7, 27 have a curved surface or bumps on the surface.

EXAMPLES

The present invention will be specifically described using specific examples. It should be noted that the present invention is not limited to the mode of such examples.

Example 1

The rear plate 61 (see FIG. 5) including the first three-dimensional structure 2 and the device electrode 1 of FIG. 1 was manufactured according to the processes of FIG. 11. In this example, a glass having a thickness of 2.8 mm of PD-200 (manufactured by Asahi Glass Co., Ltd) in which amount of alkaline component is small is sued as a substrate, and an SiO2 film having a film thickness of 200 nm is applied and formed on the glass substrate as a sodium block layer.

[Formation of Device Electrode]

After forming a Pt film having a film thickness of 20 nm on the glass substrate through the sputtering method, a photoresist is applied over the entire surface. Patterning is then carried out with a series of photolithography technique of exposure, development, and etching to form the scan signal device electrode 11 and the information signal device electrode 12 [FIG. 11A]. The high-temperature portion 3 is formed in the scan signal device electrode 11. The information signal device electrode 12 is arranged in a meandering manner to obtain high resistance. The electric resistivity of the device electrodes 11, 12 is $0.25\times10^{-6}$ [Ωn]. The scan signal device electrode 11 has an electrode width on the side connecting to the device film 17 of 20 μm, and the electrode width on the side connecting to the first three-dimensional structure 2 (connection side with wiring) of 8 μm.

[Formation of Information Signal Wiring and First Three-dimensional Structure]

Figure 11A:
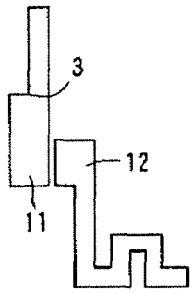
FIGS. 11A to 11F are plan frame format views showing the manufacturing process of the rear plate in an example of the present invention.
Figure 11B:
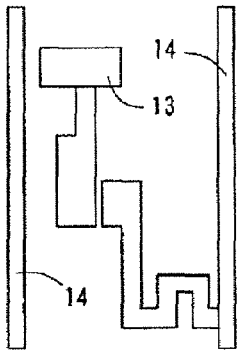
Figure 11C:
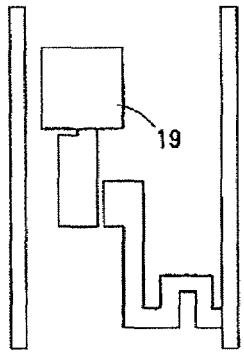

After performing screen printing using the Ag photo paste ink and drying, exposure to a predetermined pattern is performed to form the information signal wiring 14 and a first layer 13 of the first three-dimensional structure 2 [FIG. 11B]. After performing screen printing using the Ag photo paste ink and drying, exposure to a predetermined pattern is performed to form a second layer 19 of the first three-dimensional structure 2 [FIG. 11C]. The terminating end of the first three-dimensional structure 2 is connected with the scan signal wiring 16, to be hereinafter described. Thereafter, development is performed, firing is carried out at about 480° C., and the first three-dimensional structure 2 is obtained. The thickness of the first layer 13 of the first three-dimensional structure 2 is about 8 μm, the width is 80 μm, and the length is 120 μm; the thickness of the second layer 19 is about 8 μm, the width is 80 μm, and the length is 150 μm, so that one end in the length direction of the second layer serves as a protruding portion protruding over the device electrode 11. The thickness of the information signal wiring 14 is about 8 μm and the width is 20 μm. Such values are actual measurement values after formation. The electric resistivity of the formed information signal wiring 14 was measured and was found to be $0.03\times10^{-6}$ [Ωm].

[Formation of Insulating Layer]

Figure 11D:
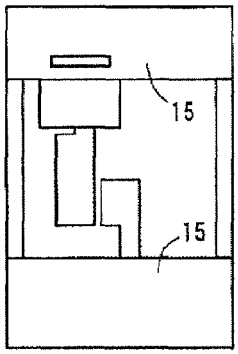

After screen printing a photosensitive paste having PbO as the main component, exposure and development are performed, and lastly firing is performed at about 460° C. to form an insulating layer 15 having a thickness of 30 μm and a width of 200 μm [FIG. 11D]. An opening is formed in a region corresponding to the terminating end of the first three-dimensional structure 2 in the insulating layer 15.

[Formation of Scan Signal Wiring]

Figure 11E:
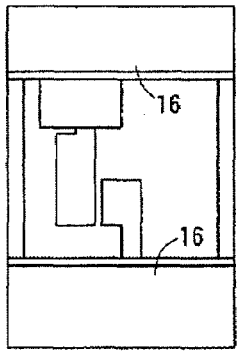

After performing screen printing using the Ag photo paste ink and drying, firing is performed at around 450° C. to form the scan signal wiring 16 intersecting the information signal wiring 14 having a thickness of 10 μm and a width of 150 μm on the insulating layer 15 [FIG. 11E]. In the relevant process, a pull-out wiring to an external drive circuit and a pull-out terminal are simultaneously formed.

The resistance of the wiring group of the present example was measured, where the resistance from the scan signal device electrode 11 formed with the device film 17 through the scan signal wiring 16 and to the external drive circuit is about 150Ω. The resistance from the information signal device electrode 12 through the information signal wiring 14 to the external drive circuit is about 1500Ω.

[Formation of Device Film and Electron-emitting Portion]

After sufficiently cleaning the substrate, the surface is treated with solution containing water repellent agent to obtain a hydrophobic property. Palladium-proline complex is dissolved in the mixed aqueous solution where water and isopropyl alcohol (IPA) is 85:15 (v/v) so that the content in the aqueous solution is 0.15% by weight thereby preparing an organic palladium containing solution. The organic palladium containing solution is prepared to a dot diameter of 50 μm with an ink jet application device using piezo device and applied between the device electrodes 11, 12. Thereafter, thermal firing process is performed for 10 minutes at 350° C. in air to obtain a palladium oxide (PdO) film having a thickness of 10 nm at maximum.

Figure 11F:
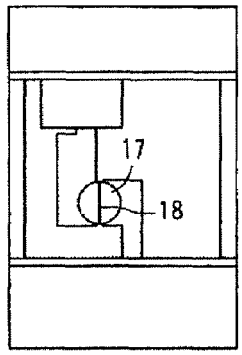

The palladium oxide film is conducted and heated under vacuum atmosphere containing slight hydrogen gas to form the device film 17 containing palladium reduced from the palladium oxide, and at the same time, the electron-emitting portion 18 is formed at one part of the device film 17 [FIG. 11F].

The trinitrile is introduced to the vacuum atmosphere, conduction process is performed on the device film 17 in vacuum atmosphere of $1.3\times10^{-4}$ Pa, and carbon or carbon compound is deposited in the vicinity of the electron-emitting portion 18.

[Formation of Display Panel]

The face plate 62 configured by stacking a fluorescence film serving as a light-emitting member on the glass substrate and a metal back serving as the anode electrode is prepared. The face plate 62 and the rear plate 61 manufactured through the above process have the frame member 64 arranged at the peripheral edge as shown in FIG. 6, and the distance between the plates is maintained to 2 mm by the spacer 63 and sealed. A matrix display panel having number of pixels of 3072×768 and pixel pitch of 200×600 μm is thereby obtained. In the face plate 62, current limiting effect on the discharge current is obtained by connecting the metal back of each pixel by way of a resistor member of a few dozen kΩ.

Fine bumps form on the surface and pattern ends become round due to the properties of the Ag paste, but they are of an extent that barely influence the evaluation of the present invention, and thus the first space 7 is assumed as a rectangular solid as shown in FIG. 1. The shape of the first space 7 was measured trough optical microscope and SEM observation, and was found that W1=80 μm, H1=8 μm, and D1=20 μm. The distance L1 between the high-temperature portion 3 and the first space 7 is 10 μm.

Example 2

Figure 12:
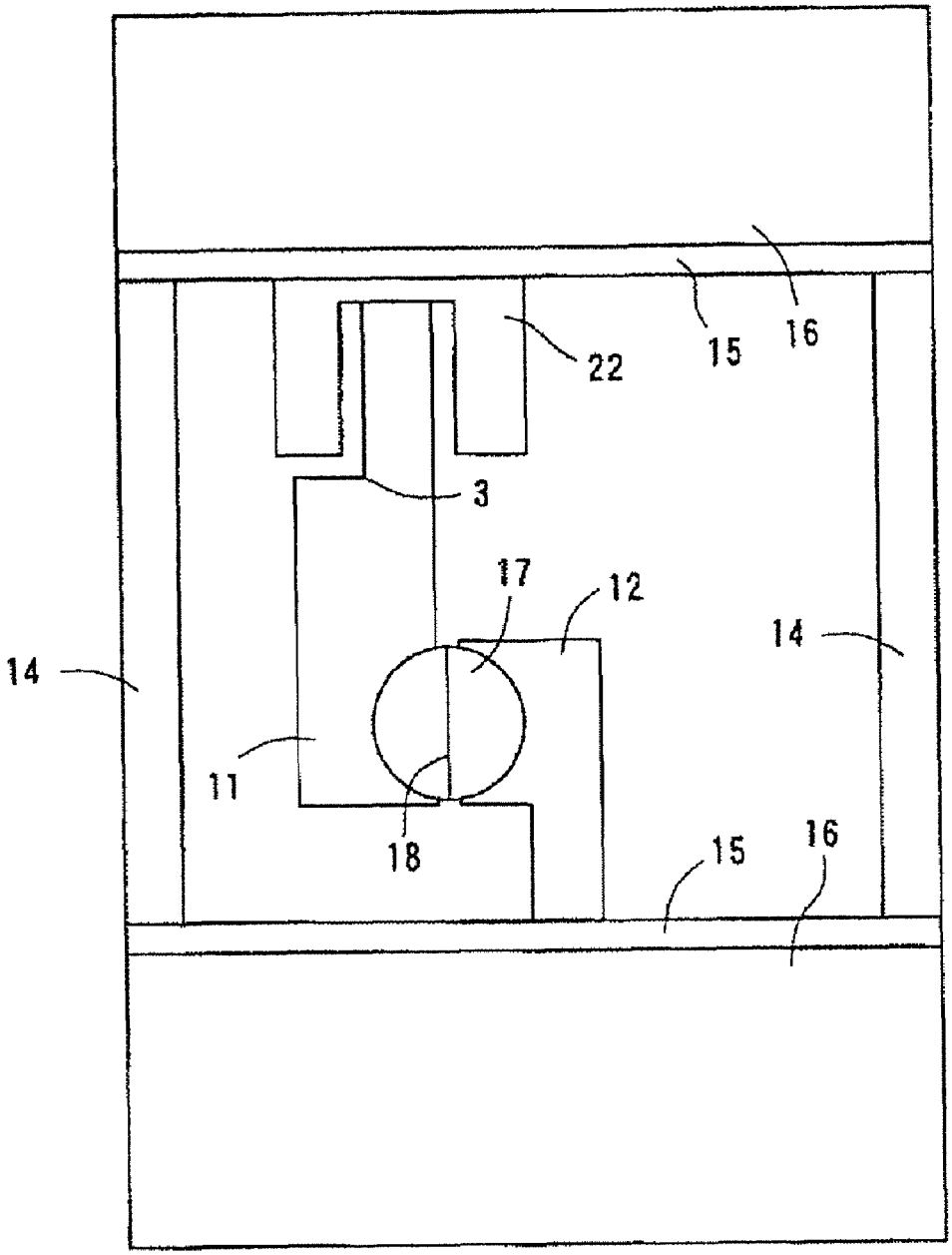
FIG. 12 is a plan frame format view of the rear plate of Example 2 of the present invention.

The rear plate 61 (see FIG. 12) including the second three-dimensional structure 22 and the device electrode 1 of FIG. 7 was manufactured.

The manufacturing process is substantially the same as the Example 1, but differs in that Ag paste is stacked in three layers and the pattern of each layer is the same shape when forming the second three-dimensional structure 22.

The thickness of the manufactured second three-dimensional structure 22 is 30 μm, the width is 80 μm, and the length is 150 μm. The thickness of the information signal wiring 14 is about 10 μm and the width is 20 μm.

The shape of the second space 27 was measured with the optical microscope and SEM observation, and was found W3=20 μm, H2=30 μm, and D2=30 μm.

The distance L2 between the high-temperature portion 3 and the second space 27 was 10 μm.

Example 3

Figure 13:
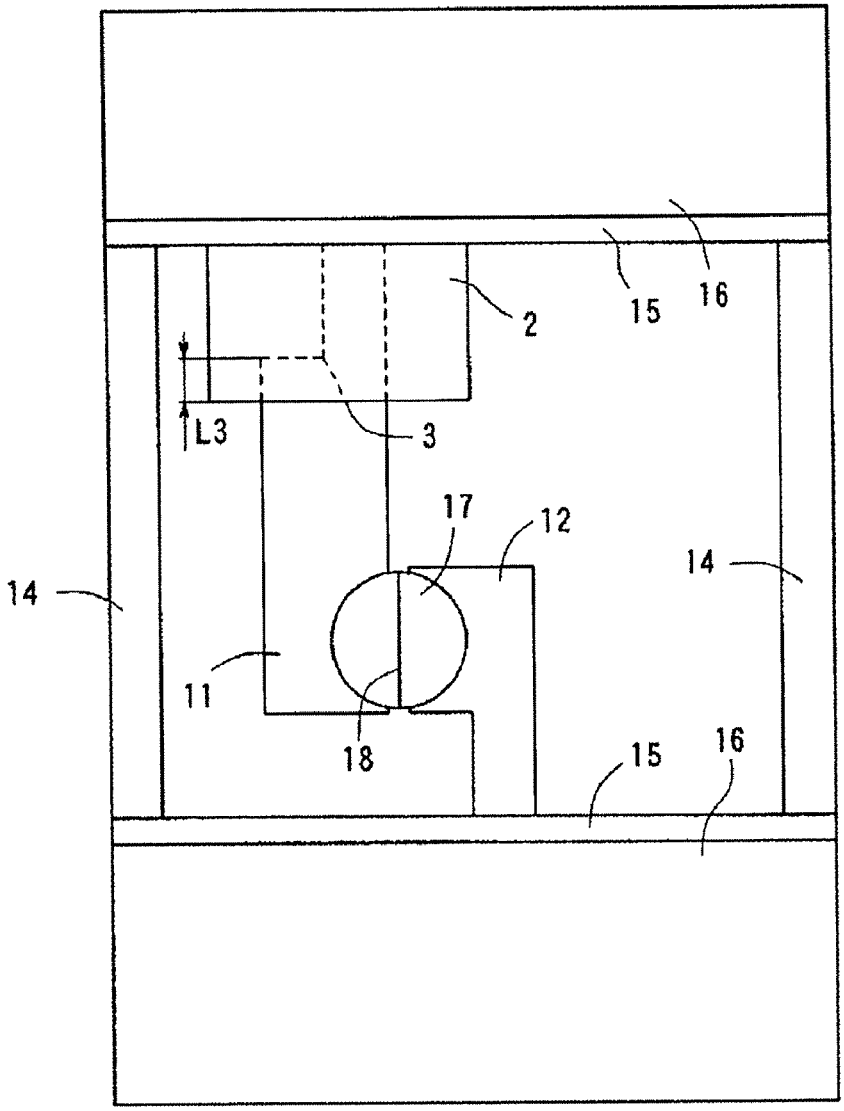
FIG. 13 is a plan frame format view of the rear plate of Example 3 of the present invention.

The rear plate shown in FIG. 13 was manufactured. In this example, the device electrode 11 was formed so that the high-temperature portion 3 of the scan signal device electrode 11 is positioned in the first space 7. The distance L3 from the end of the first three-dimensional structure 2 to the high-temperature portion 3 is 5 μm.

Comparative Example 1

Figure 14:
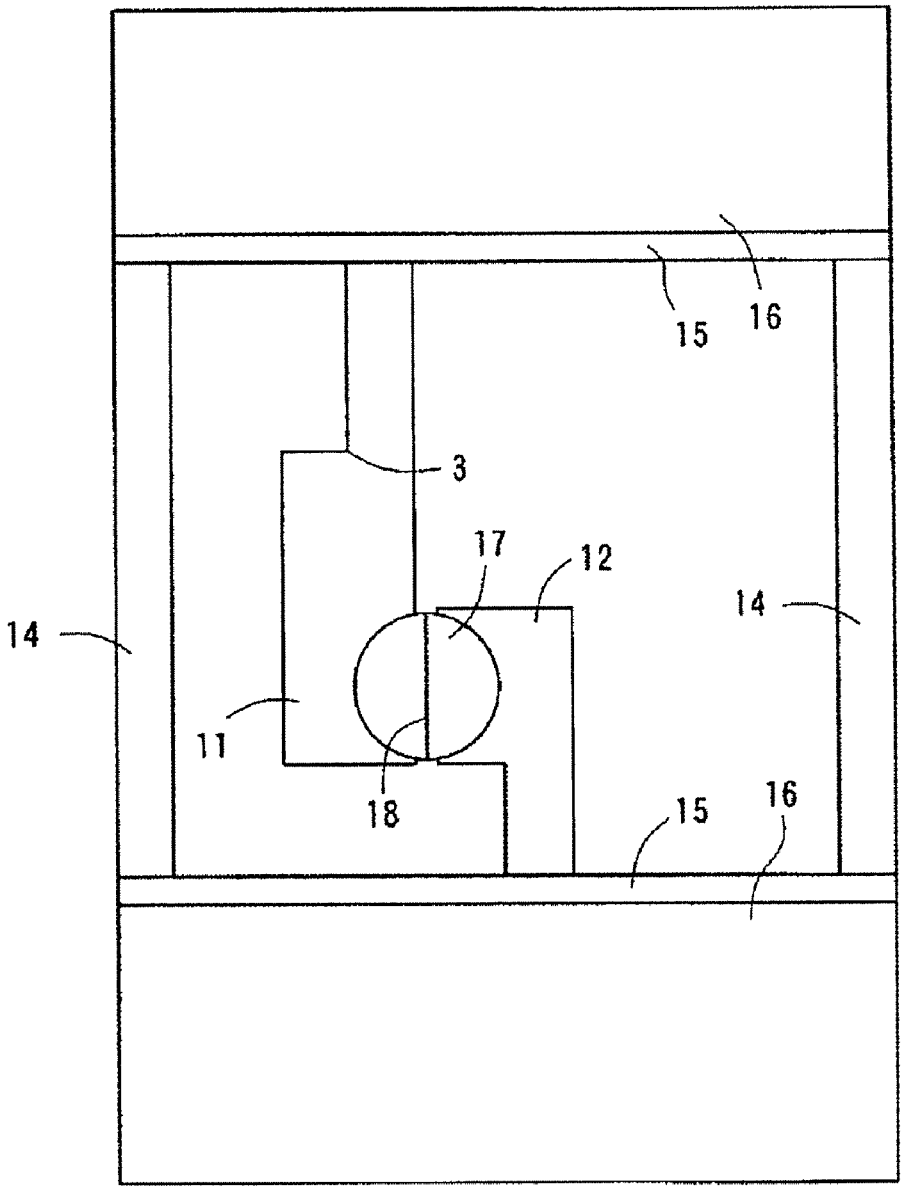
FIG. 14 is a plan frame format view of the rear plate of a Comparative Example of the present invention.

As a Comparative Example 1, a rear plate (see FIG. 14) having a similar configuration as Example 1 other than that the first three-dimensional structure 2 is not arranged was manufactured. The manufacturing process is the same as Example 1 other than that the formation process of the first three-dimensional structure 2 is excluded. The scan signal device electrode 11 and the scan signal wiring 16 are electrically connected directly to each other.

Figure 15A:
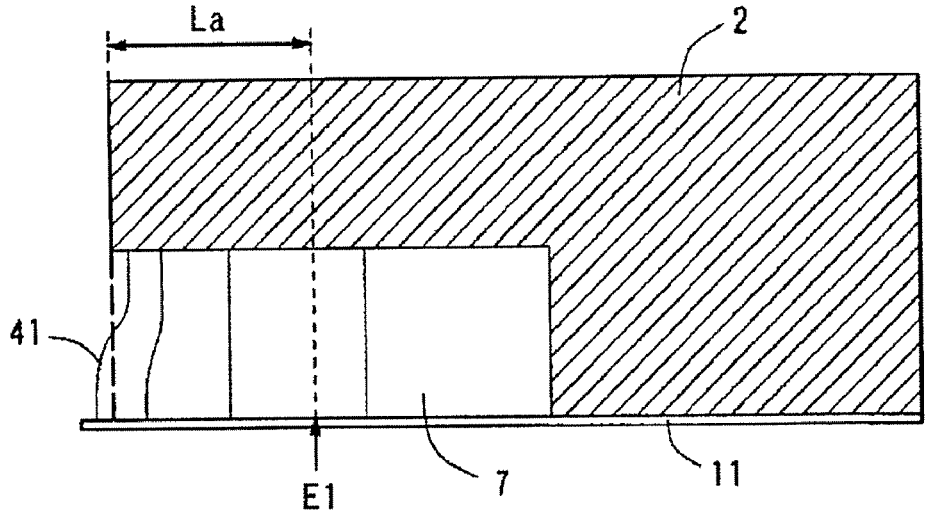
FIG. 15A is a frame format view showing an electric field distribution of the first space in Example 1 of the present invention.
Figure 15B:
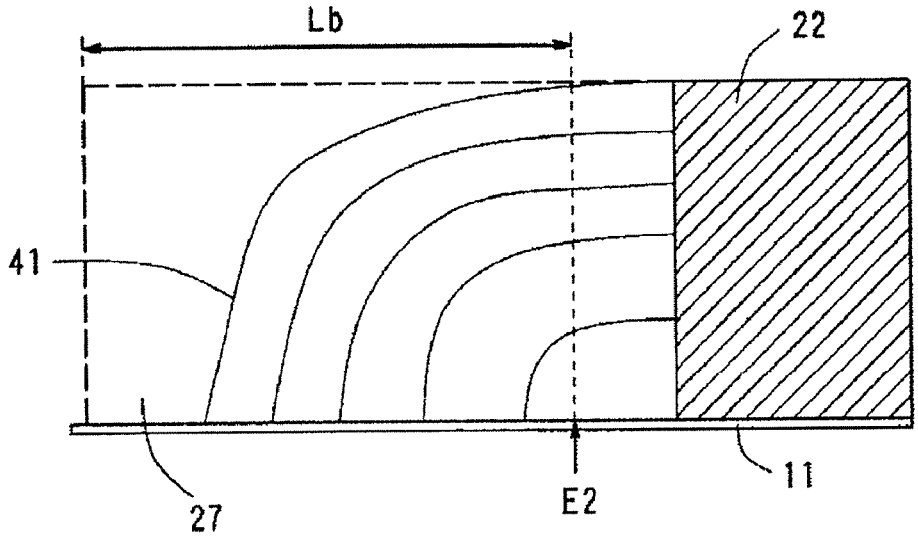
FIG. 15B is a frame format view showing an electric field distribution of the second space in Example 2 of the present invention.

In Example 1 and Example 2, the frame format view of the electric field distribution obtained in the electric field calculation is as shown in FIGS. 15A and 15B. In the figure, reference numeral 41 denotes an equipotential line. FIG. 15A shows the cross section taken along line A-B of FIG. 2A and shows the electric field intensity in the first space 7 of Example 1. E1 is the position at where the electric field intensity becomes 1/100 of the average electric field intensity outside the first three-dimensional structure 2, and the distance La from the end of the first three-dimensional structure 2 to E1 is 8 μm.

FIG. 15B shows the cross section taken along line A-B of FIG. 8A and shows the electric field intensity in the second space 27 of Example 2. E2 is the position at where the electric field intensity becomes 1/100 of the average electric field intensity outside the second three-dimensional structure 22, and the distance Lb from the end of the second three-dimensional structure 22 to E2 is 25 μm.

[Evaluation]

With respect to the display panels of Examples 1 to 3 and Comparative Example 1 obtained as above, satisfactory display was obtained in all display panels when the usual image display was carried out.

In order to check the effect of the present invention, a discharge experiment of applying overvoltage to the electron-emitting device, and artificially inducing the device discharge was performed. First, the electron-emitting device other than an appropriate pixel of address (X, Y) positioned distant from the spacer at the center of the panel and the three pixels at the periphery thereof were removed. This is because if the electron-emitting device is connected to the wiring that is driven in the discharge experiment, the current corresponding to the device characteristics tends to be added to the discharge current when voltage is applied. A method of removing the electron-emitting device is realized by irradiating YAG laser to the device film 17 from the back surface of the rear plate. Since the device film 17 is a very thin film, removal is achieved at low output.

The voltage of 1 to 10 kV is then applied to the anode electrode of the face plate 61, and −10 to −20 V, and +10 to +20 V was applied as scan signal and information signal, respectively. At the same time, the voltage of the voltage application lien and the current waveform are monitored using the voltage probe and the current probe.

In the present example, since the scan signal side has lower resistance of the voltage application path than the information signal side, the majority of the discharge current flows to the scan signal wiring 16. In terms of electric circuit, the current dividing ratio of scan signal side:information signal side=10:1 is obtained, but since the cathode spot 9 moves on the scan signal device electrode 11 thereby damaging the device film 17 and obtaining higher resistance, the current that flows to the information signal side can be assumed as substantially zero. Actually, the discharge current from the information signal wiring 14 is lower than or equal to 20 mA.

Figure 16A:
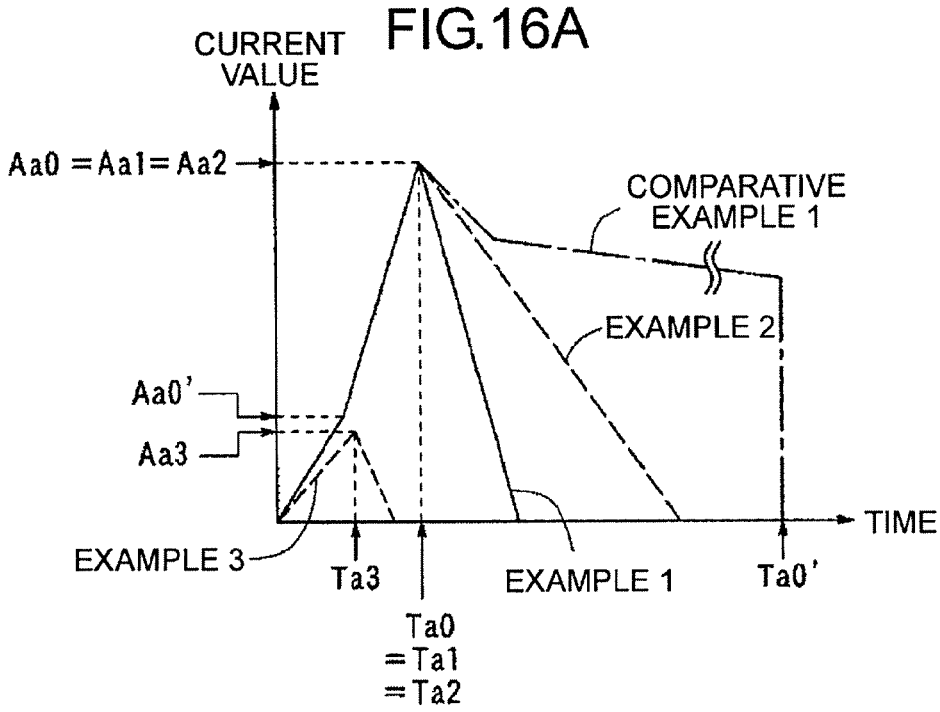
FIGS. 16A and 16B are views showing discharge current waveform in the Examples of the present invention.
Figure 16B:
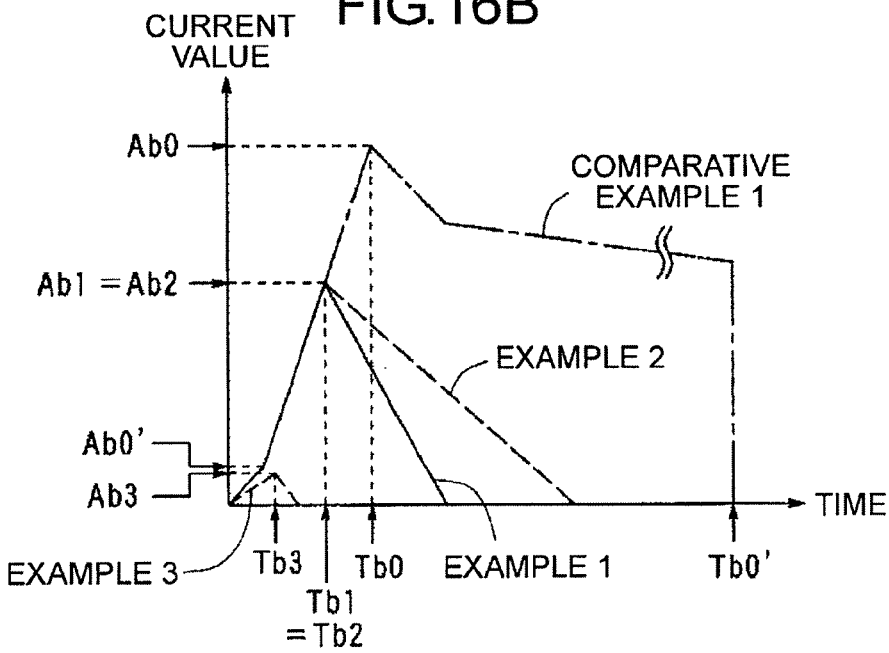

FIGS. 16A and 16B show frame format views of the discharge current waveform output from the scan signal wiring 16 of the present example. In FIG. 16A, Aa0=Aa1=Aa2=0.5 A, Aa3=0.15 A, Ta0=Ta1=Ta2=0.1 μs, Ta3=0.06 As. Aa0 and Ta0 are the maximum discharge current and discharge rise time reaching the maximum discharge current of Comparative Example 1, and Aa1 to Aa3, Ta1 to Ta3 are of the same for Examples 1 to 3. Aa0' is the current value the discharge moves the high-temperature portion 3 and takes a value 0.2 A, and Ta0' is the discharge duration of Comparative Example 1 and takes a value 60 μs.

In FIG. 16B, Ab0=2 A, Ab1=Ab2=1.2 A, Ab3=0.2 A, Tb0=0.1 As, Tb1=Tb2=0.07 μs, Tb3=0.05 As. Ab0 and Tb0 are the maximum discharge current and discharge rise time reaching the maximum discharge current of Comparative Example 1, and Ab1 to Ab3, Tb1 to Tb3 are of the same for Examples 1 to 3. The current value Ab0' the discharge moves the high-temperature portion 3 is Ab0'=0.3 A, and the discharge duration Tb0' of Comparative Example 1 is Tb0'=15 μs.

Aa0 and Ab0 in FIGS. 16A and 16B were controlled with the voltage value applied to the face plate.

With respect to Comparative Example 1, the discharge current value and the discharge duration were suppressed in Examples 1 to 3. The discharge suppressing effect is larger in Example 3 than in Examples 1 and 2 because the high-temperature portion 3 is positioned in the first space 7. The discharge duration of Example 1 and Example 2 differs because the distance until the electric field intensity value for quenching the cathode spot 9 of the first space 7 of Example 1 and the second space 27 of Example 2 differs (La<Lb).

The pixel damage of the rear plate was observed after the discharge experiment, and found that only the pixel that pseudo-generated the discharge was damaged by discharge in all the display panels of Examples 1 to 3. The damage 10 of the cathode spot 9 on the device electrode 11 was observed, and found that the distal end of the cathode spot 9 stopped at a distance of La and Lb from the end of the three-dimensional structure 2, 22. In Comparative Example 1, on the other hand, the device discharge damage extended to the adjacent pixels along the scan signal wiring 16.

An experiment in which the distance between the first and second space 2, 27 and the high-temperature portion 3 is changed was performed, and it was found that discharge current value and discharge duration similar to Comparative Example 1 were obtained when the distance exceeded 20 μm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-096401, filed on Apr. 2, 2007, which is hereby incorporated by reference herein in its entirety.

What is claimed is:

1. An electron beam apparatus comprising:

a rear plate including an electron-emitting device with a device electrode and a wiring connected to the device electrode; and a face plate which includes an anode electrode, which is arranged facing the rear plate, and which is irradiated with electrons emitted from the electron-emitting device;

wherein a three-dimensional structure forming a space in which a wiring-side portion of the device electrode is located is arranged on the rear plate;

wherein a surface potential of the three-dimensional structure is defined so that an electric field intensity of the space becomes weaker than an average electric field intensity expressed below, $$\text{average electric field intensity}=Va/d,$$

where Va is application voltage of the anode electrode, and d is an interval between the rear plate and the face plate;

wherein the device electrode includes a high-temperature portion where temperature locally rises when current flows through the device electrode, the high-temperature portion being positioned in the space or at a distance of less than or equal to 20 μm from the space; and wherein the three-dimensional structure includes a cantilever-like protruding portion which protrudes over the wiring-side portion of the device electrode, and the space is a space between the protruding portion and the rear plate.

2. An electron beam apparatus according to claim 1, wherein the surface potential of the three-dimensional structure is defined to lower than or equal to a potential of the wiring connected to the device electrode.

3. An electron beam apparatus according to claim 1, wherein the space includes a region having an electric field intensity of less than or equal to 1% of the average electric field intensity.

4. An electron beam apparatus according to claim 1, wherein the electron-emitting device includes a pair of device electrodes; and the rear plate includes a first wiring connected to one of the pair of device electrodes, and a second wiring being connected to the other device electrode and intersecting with the first wiring across an insulating layer.

5. An electron beam apparatus according to claim 4, wherein the three-dimensional structure is one part of the insulating layer.

6. An electron beam apparatus according to claim 1, wherein the three-dimensional structure is electrically connected to the device electrode or the wiring connected to the device electrode.

7. An electron beam apparatus comprising:

a rear plate including an electron-emitting device with a device electrode and a wiring connected to the device electrode; and a face plate which includes an anode electrode, which is arranged facing the rear plate, and which is irradiated with electrons emitted from the electron-emitting device;

wherein a three-dimensional structure forming a space in which a wiring-side portion of the device electrode is located is arranged on the rear plate;

wherein a surface potential of the three-dimensional structure is defined so that an electric field intensity of the space becomes weaker than an average electric field intensity expressed below, average electric field intensity=$Va/d$, where Va is application voltage of the anode electrode, and d is an interval between the rear plate and the face plate; and wherein the device electrode includes a high-temperature portion where temperature locally rises when current flows through the device electrode, the high-temperature portion being positioned in the space or at a distance of less than or equal to 20 μm from the space; and wherein the three-dimensional structure includes two wall portions arranged on both sides of the wiring-side portion of the device electrode, and the space is a space between the two wall portions.

8. An electron beam apparatus according to claim 7, wherein the three-dimensional structure is electrically connected to the device electrode or the wiring connected to the device electrode.

9. An electron beam apparatus according to claim 7, wherein the surface potential of the three-dimensional structure is defined to lower than or equal to a potential of the wiring connected to the device electrode.

10. An electron beam apparatus according to claim 7, wherein the space includes a region having an electric field intensity of less than or equal to 1% of the average electric field intensity.

11. An electron beam apparatus according to claim 7, wherein the electron-emitting device includes a pair of device electrodes; and the rear plate includes a first wiring connected to one of the pair of device electrodes, and a second wiring being connected to the other device electrode and intersecting with the first wiring across an insulating layer.

12. An electron beam apparatus according to claim 11, wherein the three-dimensional structure is one part of the insulating layer.

* * * * *